US009282860B2

(12) United States Patent
Brison

(10) Patent No.: US 9,282,860 B2
(45) Date of Patent: Mar. 15, 2016

(54) VACUUM CLEANING DEVICE FOR CHARCOAL GRILLS

(71) Applicant: Sabrina Brison, North Plainfield, NJ (US)

(72) Inventor: Sabrina Brison, North Plainfield, NJ (US)

( * ) Notice: Subject to any disclaimer, the term of this patent is extended or adjusted under 35 U.S.C. 154(b) by 0 days.

(21) Appl. No.: 14/253,984

(22) Filed: Apr. 16, 2014

(65) Prior Publication Data

US 2014/0304940 A1 Oct. 16, 2014

Related U.S. Application Data

(60) Provisional application No. 61/812,586, filed on Apr. 16, 2013.

(51) Int. Cl.

| | |
|---|---|
| ***A47L 5/36*** | (2006.01) |
| ***A47L 7/00*** | (2006.01) |
| ***A47L 9/14*** | (2006.01) |

(52) U.S. Cl.

CPC ..... *A47L 7/0071* (2013.01); *A47L 5/362* (2013.01); *A47L 9/1418* (2013.01)

(58) Field of Classification Search

CPC ..... A47L 5/36
USPC ..... 15/327.5, 399, 347, DIG. 8, 352, 327.2
IPC ..... A47L 5/36
See application file for complete search history.

(56) References Cited

U.S. PATENT DOCUMENTS

| | | | | |
|---|---|---|---|---|
| 4,868,949 | A | 9/1989 | Loveless et al. | |
| 4,944,065 | A * | 7/1990 | Svanberg et al. | 15/327.5 |
| 4,953,255 | A | 9/1990 | Jenkins | |
| 4,995,137 | A | 2/1991 | Reichborn | |
| 5,323,760 | A | 6/1994 | Johnson | |
| D358,689 | S | 5/1995 | Wallace | |
| 5,588,177 | A * | 12/1996 | Eriksen | 15/327.5 |
| 6,393,656 | B1 * | 5/2002 | Paterson et al. | 15/327.5 |
| 6,473,933 | B1 * | 11/2002 | Paterson et al. | 15/327.5 |
| 6,553,610 | B1 * | 4/2003 | Shideler | 15/327.5 |
| 6,647,586 | B2 * | 11/2003 | Rogers et al. | 15/327.5 |

* cited by examiner

*Primary Examiner* — David Redding
(74) *Attorney, Agent, or Firm* — Daniel Boudwin; Global Intellectual Property Agency LLC

(57) ABSTRACT

Described is a vacuum cleaning device for charcoal grills. The present invention includes a portable vacuum cleaning device having a vacuum source used to draw air and debris through a collection hose and into a vacuum bag. The vacuum bag and the collection hose are composed of flame-retardant material that will not melt or burn from having hot ash and embers from a grill drawn therethrough. The end of the collection hose that is secured to the vacuum cleaning device includes a fan that is used to break-up and extinguish embers drawn through the collection hose. The vacuum bag is enclosed between a housing and a lid secured thereto, and the lid is removable to allow access to the vacuum bag. The vacuum cleaning device also includes one or more straps thereon that can be adjustably secured together such that a user can wear the device over the user's shoulder.

18 Claims, 4 Drawing Sheets

VACUUM CLEANING DEVICE FOR CHARCOAL GRILLS

CROSS REFERENCE TO RELATED APPLICATION

This application claims the benefit of U.S. Provisional Application No. 61/812,586 filed on Apr. 16, 2013, entitled "Charcoal Grill Vacuum." The above identified patent application is herein incorporated by reference in its entirety to provide continuity of disclosure.

BACKGROUND OF THE INVENTION

1. Field of the Invention

The present invention relates to vacuum cleaning devices. More specifically, the present invention describes a vacuum cleaning device for charcoal grills that is able to remove hot ash and embers from a grill. The vacuum cleaning device comprises an elongated collection hose composed of heat-resistant material through which ashes and embers can be drawn. The ashes and embers are collected in a vacuum bag that is also composed of heat-resistant material. A fan is positioned at an end of the collection hose and is adapted to extinguish and break-up hot embers drawn into the hose before the embers are stored within the vacuum bag. The housing comprises one or more straps thereon such that a user can easily hold and transport the vacuum device by carrying the device over the user's shoulder or shoulders.

Many individuals enjoy cooking with charcoal grills in part because of the smoky flavor that charcoal grills impart on food. The smoky flavor cannot be achieved with electric or gas grills, which makes charcoal grills particularly desirable. Further, charcoal grills are able to reach high temperatures that are well suited for charring and searing meats and other food. Other types of grills may not be able to reach such high temperatures, or may take a longer period of time to reach these temperatures.

Despite the benefits of charcoal grills, cleaning charcoal grills after use can be time consuming and messy. Further, the charcoal embers in the grill produce a substantial amount of heat and can pose a fire hazard because the embers may burn long after the fire that created the embers is extinguished. As the charcoal burns, ash is created and is left within the grill after use. Accordingly, after the user is finished using the grill, the user must generally wait to clean the grill until a time when the ash has cooled. Thus, the user must return to the grill long after it has been used in order to clean the grill, which may be inconvenient for the user. Further, when cleaning a charcoal grill by hand, an individual's hands may become covered with ash and the individual's clothes may become soiled. As a result, many individuals clean their charcoal grills infrequently which may negatively affect the operation and efficiency of the grill.

The present invention provides a vacuum cleaning device for charcoal grills comprising an elongated collection hose through which ashes and embers can be drawn. The elongated collection hose is composed of a flame-retardant material and is connected to an opening on a lid removably secured to the housing of the vacuum cleaning device. The collection hose is in fluid communication with a porous vacuum bag that is enclosed between the vacuum cleaning device housing and the lid. A fan is positioned on the opening of the lid where the collection hose is secured, and the fan is adapted to extinguish any embers or ashes drawn through the hose prior to their entry into the vacuum bag. The housing encloses a vacuum source used to provide suction and permit airflow into the vacuum cleaning device. The housing further comprises flexible straps that allow a user to wear the vacuum cleaning device over the user's shoulder.

2. Description of the Prior Art

Devices have been disclosed in the prior art that relate to vacuum cleaning devices. These include devices that have been patented and published in patent application publications. These devices generally relate to vacuum cleaning devices for hot ash in fireplaces or stoves. The following is a list of devices deemed most relevant to the present disclosure, which are herein described for the purposes of highlighting and differentiating the unique aspects of the present invention, and further highlighting the drawbacks existing in the prior art.

One such device is U.S. Pat. No. 4,953,255 to Jenkins, which discloses a device comprising a canister having an outer housing and an inner housing. The housing is enclosed by a cap that includes a vacuum motor which extends into the inner housing and which is connected to a flexible hose. The hose is open at one end for collection of ash and is disposed in the inner housing at the other end. The inner housing is further connected to a dust collector in which the collected ash may accumulate. Thus, Jenkins fails to disclose a portable vacuum cleaning device having a fan that is adapted to break-up and extinguish hot embers drawn through a collection hose.

U.S. Pat. No. 5,323,760 to Johnson discloses a vacuum for use with a wood burning stove. A vacuum is disposed on the stove housing and comprises a vacuum motor, a bag, and a hose used for removing ash from the combustion chamber of the stove. The vacuum hose transports combusted material from the combustion chamber to a vacuum bag in the vacuum apparatus in order to keep the stove clean. Thus, Johnson discloses a vacuum installed on a wood burning stove, and does not disclose a portable vacuum cleaning device having straps so that the vacuum can be worn by a user.

U.S. Pat. No. 4,868,949 to Loveless et al. discloses an adapter for connection to a vacuum source to pull hot ashes through a flame-retardant hose for storage in a canister housing. The vacuum source creates a vacuum through a filter arranged within the canister, and the filter includes a cylindrical sleeve composed of a fireproof material. Thus, Loveless disclose a vacuum adapter for connection to a vacuum source and does not disclose a vacuum cleaning device comprising a vacuum source and a vacuum bag, and wherein the vacuum cleaning device includes straps that allow the device to be worn over a user's shoulders.

U.S. Pat. No. 4,995,137 to Reichborn discloses a vacuum cleaning device adapted to remove soot and ash from fireplaces having a vacuum source, an intermediate container, and a tube through which ashes can be drawn. A disposable bag is positioned within the intermediate container for receiving the ashes. Thus, while Reichborn discloses a vacuum cleaning device for cleaning ash from fireplaces, Reichborn fails to disclose a portable vacuum cleaning device having a fan with blades disposed on the collection hose that is used to break-up or extinguish hot embers.

Finally, U.S. Design Pat. D358,689 to Wallace, discloses an ornamental design for a vacuum for use with a wood or coal fireplace or stove. The device comprises a canister that is substantially cylindrical and comprises a lid thereon. A hose extends from the canister and can be used to draw ash into the canister. Further, the canister includes wheels thereon so that the vacuum device can be easily moved. Thus, Wallace fails to disclose a portable vacuum cleaning device for charcoal grills comprising a housing with straps thereon such that the vacuum cleaning device can be worn over a user's shoulder. Further, Wallace fails to disclose a vacuum cleaning device with a fan disposed on an end of a collection hose that is used to break-up or extinguish embers drawn through the hose.

These prior art devices have several known drawbacks. Several patents in the prior art disclose vacuum cleaning devices comprises a canister into which ash and embers can be drawn. Such canisters are not portable and are not adapted to be carried by a user. The vacuum cleaning devices in the prior art are bulky and cumbersome for a user to transport. Further, while several devices in the prior art are adapted to vacuum hot ash, such devices do not provide a means for breaking-up larger embers drawn through the vacuum hose. The present invention provides a fan on the housing such that ash and embers drawn through the collection hose are passed through the fan so that they can be broken-up or extinguished prior to entering the vacuum filter.

In light of the devices disclosed in the prior art, it is submitted that the present invention substantially diverges in design elements from the prior art and consequently it is clear that there is a need in the art for an improvement to existing vacuum cleaning devices for cleaning ash and embers from grills, stoves, fireplaces, and similar areas. In this regard the instant invention substantially fulfills these needs.

SUMMARY OF THE INVENTION

In view of the foregoing disadvantages inherent in the known types of vacuum cleaning devices now present in the prior art, the present invention provides a new vacuum cleaning device wherein the same can be utilized for providing convenience for the user when cleaning hot ash and embers from a charcoal grill after use.

It is therefore an object of the present invention to provide a new and improved vacuum cleaning device that has all of the advantages of the prior art and none of the disadvantages.

It is another object of the present invention to provide a vacuum cleaning device for charcoal grills that can remove hot ash and embers from a charcoal grill.

Another object of the present invention is to provide a vacuum cleaning device for charcoal grills that can be easily transported and carried by a user, and that can be worn over a user's shoulders.

Yet another object of the present invention is to provide a vacuum cleaning device for charcoal grills comprising a fan that extinguishes hot embers drawn in through the collection hose.

Another object of the present invention is to provide a vacuum cleaning device for charcoal grills that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
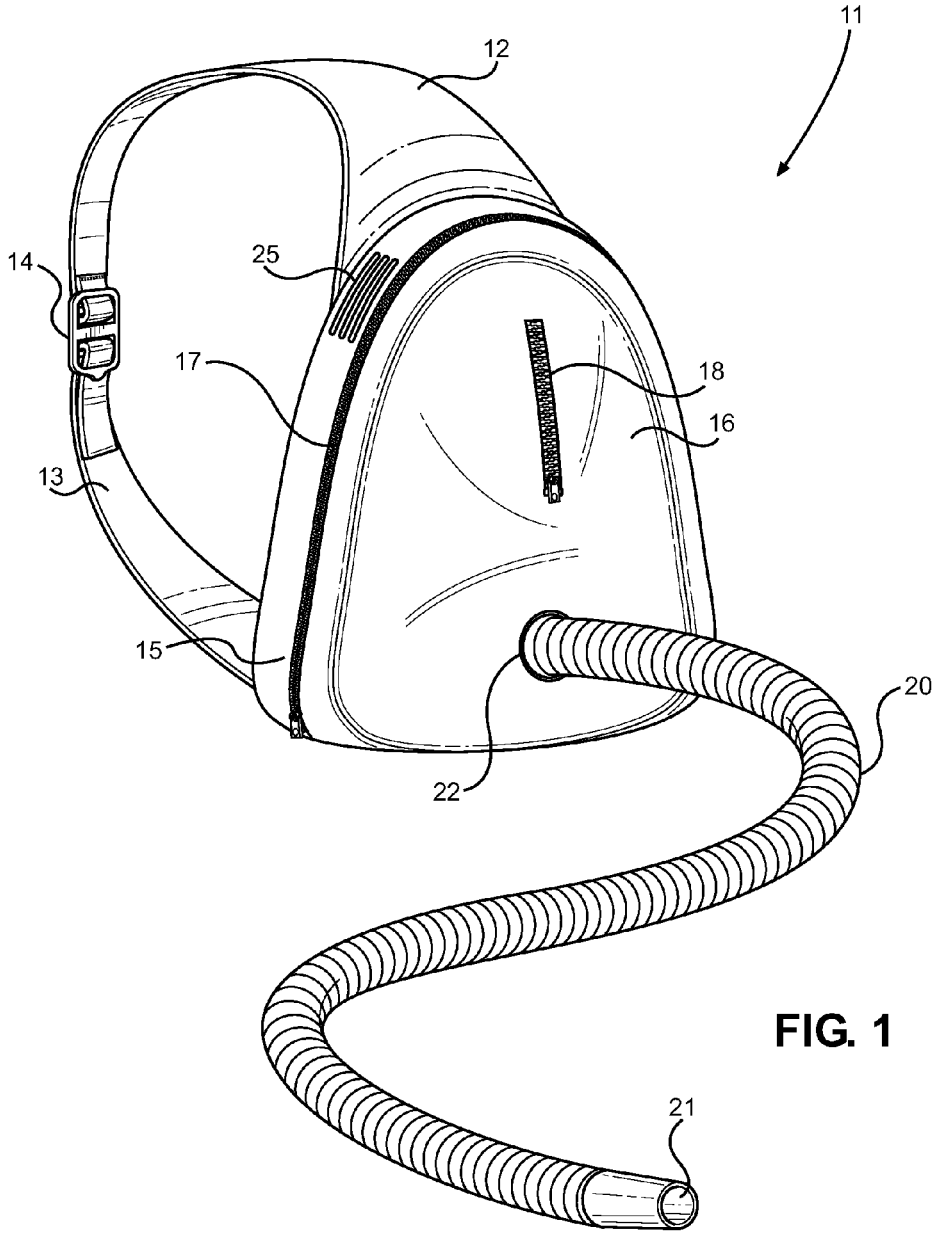
FIG. 1 shows a perspective view of an embodiment of the vacuum cleaning device for of the present invention.

Reference is made herein to the attached drawings. Like reference numerals are used throughout the drawings to depict like or similar elements of the vacuum cleaning device for use with charcoal grills. For the purposes of presenting a brief and clear description of the present invention, the preferred embodiment will be discussed as used for removing hot ash and embers from a charcoal grill. The figures are intended for representative purposes only and should not be considered to be limiting in any respect.

Referring now to FIG. 1, there is shown a perspective view of an embodiment of the vacuum cleaning device of the present invention. The present invention comprises a housing 15 having a front surface and a back surface, wherein a lid 16 is removably secured to the front surface of the housing 15. The back surface of the housing 15 is adapted to rest against a user when the vacuum cleaning device 11 is in use. The housing 15 preferably comprises a hard plastic, or other lightweight, rigid material. The housing 15 contains the vacuum source used to create suction and draw airflow into the vacuum cleaning device 11. The housing 15 may also contain an internal power source, such as one or more rechargeable batteries.

The lid 16 can be removably sealed to the housing 15 so as to maintain a vacuum within the interior of the housing 15. The lid 16 can be removably sealed to the housing by any suitable means such as by press fitting the lid 16 onto the housing 15, or by means of a zipper connection 17 between the lid 16 and the housing 15, provided that the zipper is adapted to maintain a vacuum within the housing 15. The lid 16 preferably has a convex shape such that when the lid 16 is secured to the housing 15, an interior volume is enclosed therebetween and in which a vacuum bag can be positioned. Thus, once a vacuum bag positioned within the interior volume is filled with ash and other debris, the user can remove the lid 16 in order to gain access to the vacuum bag. The user can them remove a vacuum bag that has been filled with debris, and can insert a new vacuum bag.

In some embodiments of the present invention, the housing 15 and lid 16 are composed of a hard plastic. The lid 16 and the front surface of the housing 15 have insulating material thereon so as to prevent transfer of the heat from ash and embers collected within the vacuum bag positioned between the front surface of the housing 15 and the lid 16 from transferring to the vacuum source within the housing, and to the exterior surface of the lid 16. Excessive heat transferred to the vacuum source of the vacuum cleaning device 11 may damage the vacuum source, detrimentally affecting the operation of the device. Further, the exterior of the lid 16 may come in contact with the user, so it is important that the exterior surface of the lid 16 does not reach a temperature that could burn a user if the user comes in contact with the lid 16.

In other embodiments of the present invention, the lid 16 is composed of an insulated fabric material that helps to prevent transfer of heat from the hot ash collected inside of the housing 15 to the exterior of the housing 15. The material is adapted to allow for a vacuum to be created within the interior of the housing 15. Further, in such embodiments the housing 15 may include a rigid frame therein to help maintain the shape of the vacuum cleaning device 11, and to prevent the housing 15 or lid 16 from deforming as result of the vacuum created within the vacuum cleaning device 11.

The vacuum cleaning device 11 of the present invention further comprises a collection hose 20 having a first end 22 connected to the lid 16 and a second end 21 that is open to allow a user to draw ashes, embers, and other debris therethrough. The collection hose 20 is elongated and is flexible such that the collection hose 20 can easily be used to clean ash and debris from various areas. The first end 22 is in fluid communication with a vacuum bag positioned between the front of the housing and the lid, such that ash drawn through the collection hose 20 is deposited within the vacuum bag for later disposal. The second end 21 of the collection hose 20 is used to draw ash and debris through the collection hose 20 and into a vacuum bag. The second end 21 may comprise a removable nozzle thereon to aid in cleaning a grill, fireplace, or other area.

Further, the second end 21 of the collection hose 20 may be adapted to receive any of a variety of attachments thereon that can be used to aid the user in cleaning a grill or other area. The attachments may include a narrow nozzle with a small opening for reaching ashes and debris in crevices. Alternatively, an attachment may include a relatively wide opening for drawing larger quantities of ash and debris therethrough.

The collection hose 20 is composed of a flame-retardant material so that the hot ash and embers drawn through the collection hose 20 do not melt or otherwise damage the collection hose 20. Further, the collection hose 20 includes an insulated covering on the exterior surface thereof. The insulated covering may be substantially tubular so as to substantially cover the collection hose 20. In this way, the exterior surface of the collection hose 20 remains cool, so that the user does not burn himself or herself by touching the collection hose 20.

The housing 15 further comprises one or more straps 12,13 that can be adjustably secured by means of a buckle 14 or similar fastener. The buckle 14 allows the length of the straps 12,13 to be adjusted so as to allow a user to choose a desired strap length. In a preferred embodiment of the invention, the housing 15 comprises a pair of straps 12,13 wherein a first strap 12 is secured to a top portion of the housing 15, and a second strap 13 is secured to a bottom portion of the housing 15. In this way, a user can secure the straps 12,13 together and can dispose the straps over one of the user's shoulder such that the back surface of the housing 15 can rest against the user's midsection.

In operation, a user can secure the straps 12,13 together by means of a buckle 13 and can adjust the straps 12,13 to the desired length. The user can then dispose a strap 12 over the user's shoulder and position the back of the housing 15 against the front of the user's body, near the user's midsection. With the vacuum cleaning device 11 positioned securely over the user's shoulder, the user may then hold the collection hose 20 with one hand and can direct the collection hose 20 towards areas that the user desires to clean. In some embodiments of the present invention, the collection hose 20 has a handle thereon to aid the user in holding and directing the collection hose 20 to desired locations.

Figure 2:
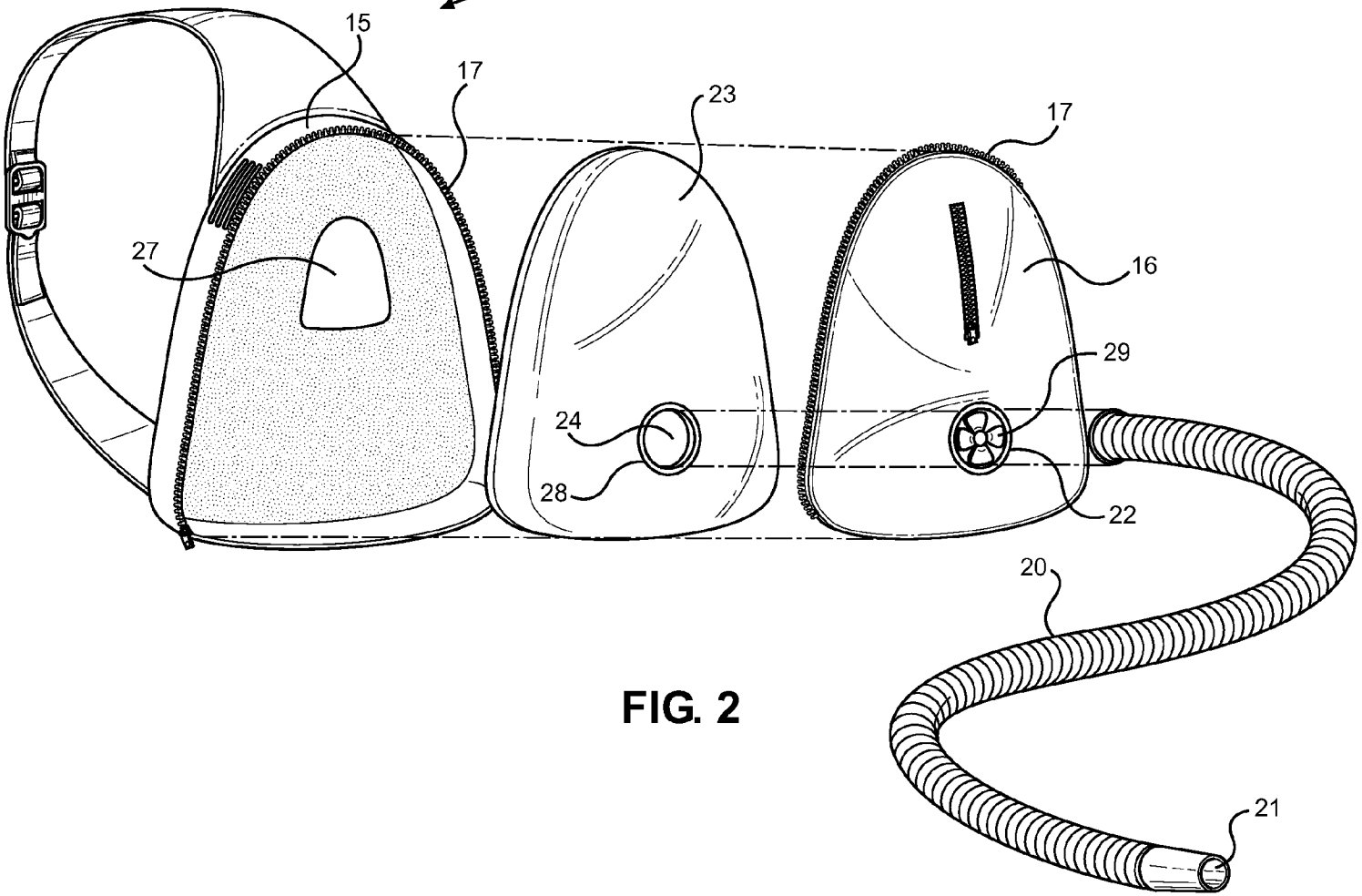
FIG. 2 shows a perspective view of the components of the vacuum cleaning device as positioned for assembly.

Referring now to FIG. 2, there is shown a perspective view of the components of the vacuum cleaning device as positioned for assembly. The collection hose 20 can be removably secured to the lid 16 by any suitable fastening means. For example, the collection hose 20 can be press fitted onto the lid 16, or may have threading thereon to secure to threading on the lid 16.

The lid 16 comprises an opening thereon such that ashes and debris drawn through the collection hose 20 can pass through the opening of the lid 16 and into a vacuum bag 23 positioned between the lid 16 and the housing 15. The opening on the lid 16 comprises a fan 29 thereon with one or more blades. The fan 29 is adapted to break-up or extinguish hot embers drawn through the collection hose 20. This helps to reduce the heat produced by the embers so that the embers do not continually produce heat within the vacuum cleaning device 11. Further, the fan 29 helps to break up the embers into smaller pieces in order to facilitate cooling of the embers. The blades of the fan 29 are adapted to automatically rotate when the vacuum source is being used, and the fan blades rotate as result of the airflow through the vacuum cleaning device 11. The fan blades may be disposed at an angle in order to achieve this effect. Alternatively, the fan 29 can be electrically powered by a power source provided by the vacuum cleaning device 11 and positioned within the housing 15.

The vacuum bag 23 comprises a flexible bag composed of a porous or breathable material that allows air to pass therethrough, but that prevents ash and debris from passing therethrough. The vacuum bag 23 is composed of a flame-retardant, non-flammable material so as to prevent ashes and embers therein from melting or burning the vacuum bag 23. The vacuum bag 23 is enclosed between the lid 16 and the front surface of the housing 15. The vacuum bag 23 comprises an aperture 25 therethrough and the vacuum bag can be removably secured to an interior surface of the lid 16 such that the collection hose 20 is in fluid communication with the vacuum bag 23, and debris drawn through the hose 20 can be collected in the vacuum bag 23. The vacuum bag 23 secures to the interior of the lid 16 by any suitable means, and the vacuum bag 23 may comprise a flange 28 about the perimeter of the opening 24 for securement to the lid 16.

The front surface of the housing 15 comprises an aperture 27 that allows for fluid communication between the vacuum bag 23 and the interior of the housing 15 in which the vacuum source is positioned. Air drawn through the collection hose 20 and vacuum bag 23 passes into the interior volume of the housing 15 and escapes the vacuum cleaning device 11 through a plurality of vents 25 disposed on the housing 15. The aperture 27 on the front of the housing 25 is sized so as to prevent the vacuum bag 23 from passing therethrough, and the aperture 27 may be disposed at an elevated position on the vacuum cleaning device 11 relative to the connection of the collection hose 20 to the lid 16.

Figure 3:
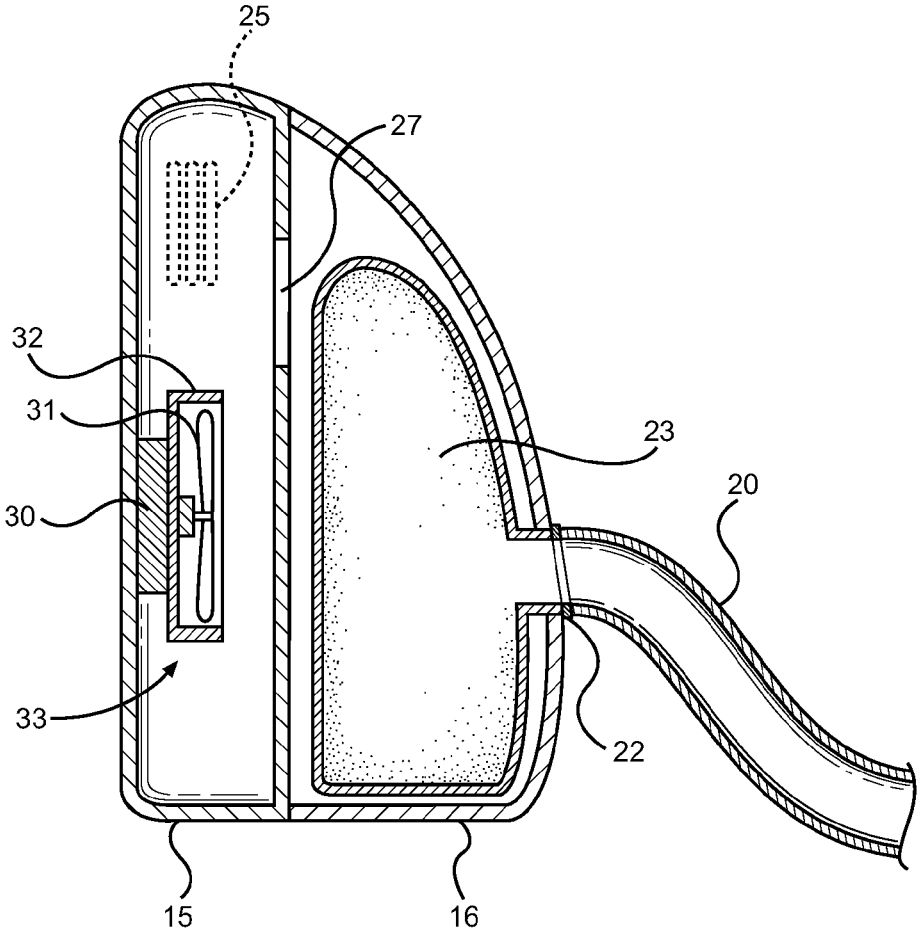
FIG. 3 shows a cross-sectional view of an embodiment of the vacuum source of the present invention.

Referring now to FIG. 3, there is shown a cross sectional view of the vacuum source within the housing of the vacuum cleaning device. The interior of the housing 15 comprises a conventional vacuum source 33. A conventional vacuum source 33 generally includes a vacuum motor 30 and fan 31 that rotates in order to create a low pressure area. The fan 31 may be partially enclosed by a shell 32 that helps to protect the fan 31 from contacting other surfaces, and to prevent a user from accidentally contacting the fan 31. The vacuum source 33 generates the suction required to allow the collection hose 20 to draw ash and debris into the vacuum bag 23. Any suitable vacuum source can be included within the housing 15, and it is submitted that vacuum sources and mechanisms for creating a vacuum are well known in the art. Vents 25 are positioned on the housing to allow air drawn into the vacuum cleaning device 11 through the collection hose 20 to exit the vacuum cleaning device 11. The vents 25 allow air to be exhausted from the interior of the housing 15. A filter may be removably positioned on the vents, wherein the filter is adapted to prevent dust and ash from being exhausted from the vacuum cleaning device 11. The filter may be a high-efficiency particular absorption (HEPA) filter.

The exterior of the housing 15 comprises a power switch thereon that allows the user to turn the vacuum source on or off. Further, the housing 15 may have additional controls thereon that allow a user to determine the strength or suction power of the vacuum cleaning device. The vacuum cleaning device 11 may be powered by an external power source, such as a household power outlet, or may include an internal power source, such as one or more rechargeable batteries.

Figure 4A:
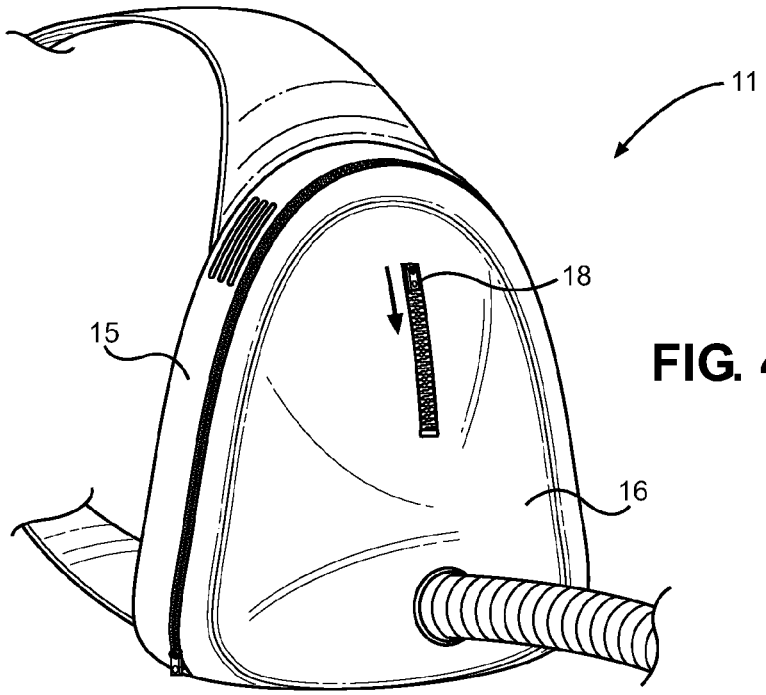
FIG. 4A shows a perspective view of the vacuum cleaning device of the present invention wherein the vacuum filter is empty.
Figure 4B:
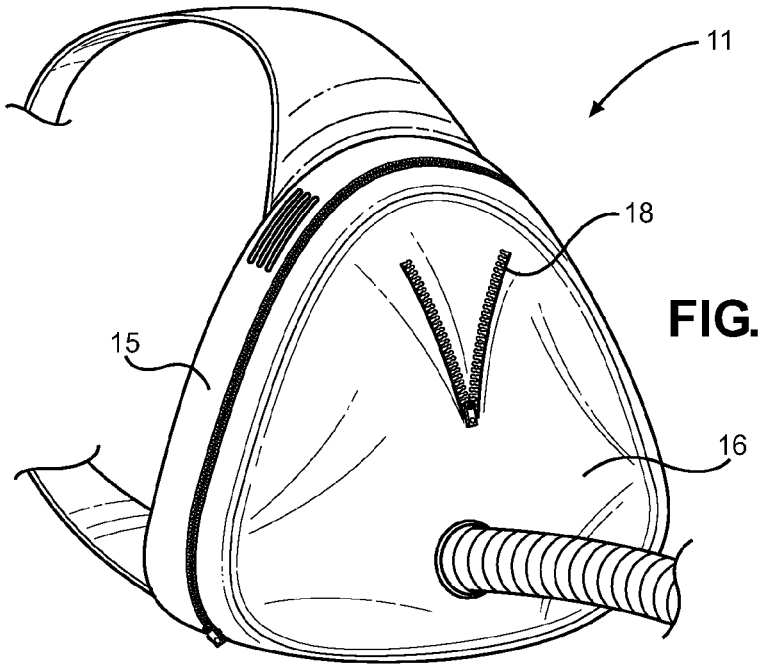
FIG. 4B shows a perspective view of the vacuum cleaning device of the present invention wherein the vacuum filter is full.

Referring now to FIGS. 4A and 4B, there are shown perspective views of the vacuum cleaning device of the present invention wherein the vacuum filter is empty and full, respectively. In embodiments of the present invention wherein the lid 16 is composed of a fabric material, the lid 16 comprises excess fabric that is held together by a zipper 18 that is arranged vertically on the lid 16. In a closed position, the zipper 18 maintains a small, compact configuration of the lid 16, and stores the excess fabric. However, as the vacuum bag fills, the bag expands, requiring the lid 16 to expand as well. Thus, a user can open the zipper 18 in order to allow the excess fabric to stretch such that the lid 16 can expand as shown in FIG. 4B. By opening the zipper 18, the lid 16 provides sufficient volume for the vacuum bag therein to be filled with ash and debris.

People often need to clean up ash and embers in locations such as charcoal grills, fireplaces, stoves and furnaces in order to clean and maintain those devices. However, ashes and embers cannot easily be cleaned until the ashes have had time to cool, requiring the user to wait an extended period of time before cleaning the ashes and embers. Further, cleaning ashes and embers by hand can cause the person to become dirty and the ash and dust may stain or damage the person's clothes. Thus, the present invention provides a vacuum cleaning device that is adapted to remove hot ash and embers from a charcoal grill or similar device. The present invention provides a collection hose composed of a flame-retardant material that can be used to draw ash and debris into a vacuum bag positioned within the vacuum cleaning device. The vacuum bag is stored between a housing in which a vacuum source is positioned and a lid to which the collection hose is connected. The lid can be secured to the housing such that the vacuum bag is enclosed therebetween. Further, the housing comprises elongated straps that allow the user to carry the vacuum cleaning device over the user's shoulder.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vacuum cleaning device, comprising:

a housing having a back surface, a front surface, and an interior volume enclosed therein, wherein said front surface of said housing comprises an aperture therethrough;

wherein said interior volume comprises a vacuum source therein;

a lid having an interior surface and an exterior surface, wherein said lid is removably secured to said front surface of said housing, wherein said lid comprises an opening thereon;

a collection hose having a first end and a second end, wherein a first end of said collection hose is removably secured about said opening on said lid, and wherein said second end is open and is adapted to draw debris into said collection hose;

a fan with one or more blades positioned over said opening on said lid;

a vacuum bag comprising a porous material wherein said vacuum bag is removably secured to said interior surface of said lid about said opening on said lid, such that debris drawn through said collection hose is collected in said vacuum bag;

a first strap secured to a top end of said housing, a second strap secured to a bottom end of said housing, wherein said first and second straps are adjustably secured to one another by means of a fastener.

2. The vacuum cleaning device of claim 1, wherein said vacuum bag is composed of a flame-retardant material.

3. The vacuum cleaning device of claim 1, wherein said front surface of said housing and said lid comprise insulating material thereon.

4. The vacuum cleaning device of claim 1, said collection hose is composed of a flame-retardant material.

5. The vacuum cleaning device of claim 1, wherein said collection hose comprises insulating material on an exterior surface thereof.

6. The vacuum cleaning device of claim 1, wherein said collection hose is flexible.

7. The vacuum cleaning device of claim 1, wherein said collection hose comprises a handle thereon.

8. The vacuum cleaning device of claim 1, further comprising a rechargeable battery disposed in said housing, wherein said rechargeable battery is adapted to power said vacuum source.

9. The vacuum cleaning device of claim 1, wherein said vacuum source comprises a vacuum motor and fan.

10. The vacuum cleaning device of claim 1, wherein said one or more blades on said fan are disposed at an angle such that airflow through said fan causes said one or more blades to rotate.

11. The vacuum cleaning device of claim 1, wherein said lid is composed of an insulated fabric material.

12. The vacuum cleaning device of claim 1, wherein said lid comprises a convex shape such that a volume is enclosed between said lid and said front surface of said housing.

13. The vacuum cleaning device of claim 1, wherein said housing comprises one or more exhaust vents thereon.

14. The vacuum cleaning device of claim 1, wherein a filter is disposed on said exhaust vents and within said housing.

15. The vacuum cleaning device of claim 1, wherein said fastener is a buckle.

16. The vacuum cleaning device of claim 1, wherein said lid is removably secured to said housing by press fitting said lid onto said housing.

17. The vacuum cleaning device of claim 1, wherein said housing comprises a power button thereon adapted to allow a user to selectively turn the vacuum source on or off.

18. The vacuum cleaning device of claim 1, wherein said housing is composed of a hard plastic.

* * * * *